United States Patent [19]

Sweeny et al.

[11] Patent Number: 4,747,561

[45] Date of Patent: May 31, 1988

[54] REEL ASSEMBLY

[75] Inventors: Henry D. Sweeny, Kitchener; Antonio D. Sabbadin, Waterloo, both of Canada

[73] Assignee: Swenco, Ltd., Ontario, Canada

[21] Appl. No.: 61,472

[22] Filed: Jun. 15, 1987

[30] Foreign Application Priority Data

Jul. 10, 1986 [CA] Canada ..... 515513

[51] Int. Cl.[4] ..... B65H 75/40; B65H 75/22

[52] U.S. Cl. ..... 242/96; 242/99; 242/116

[58] Field of Search ..... 242/115, 116, 71.8, 242/118.61, 118.32, 96, 99

[56] References Cited

U.S. PATENT DOCUMENTS

| | | | |
|---|---|---|---|
| 2,438,188 | 3/1948 | Thrower | 242/99 |
| 2,928,619 | 3/1960 | Burton et al. | 242/118.61 X |
| 2,992,789 | 7/1961 | Sardeson | 242/118.61 X |
| 3,430,893 | 3/1969 | Johnson et al. | 242/118.61 X |
| 3,731,887 | 5/1973 | Wheeler | 242/96 |
| 3,822,841 | 7/1974 | Campbell | 242/115 |
| 3,830,443 | 8/1974 | Quenot | 242/99 X |
| 3,937,415 | 2/1976 | Prinz | 242/99 X |
| 3,940,085 | 2/1976 | Campbell | 242/115 |
| 4,128,215 | 12/1978 | Underwood | 242/115 X |
| 4,176,807 | 12/1979 | Kwon | 242/96 |
| 4,238,086 | 12/1980 | Brimmeier | 242/96 |
| 4,596,365 | 6/1986 | Wang | 242/96 |

FOREIGN PATENT DOCUMENTS

| | | | |
|---|---|---|---|
| 931338 | 2/1948 | France | 242/99 |
| 642280 | 8/1950 | United Kingdom . | |
| 682692 | 11/1952 | United Kingdom . | |
| 957206 | 5/1964 | United Kingdom . | |
| 965093 | 7/1964 | United Kingdom . | |
| 1174482 | 12/1969 | United Kingdom . | |
| 1252785 | 11/1971 | United Kingdom . | |
| 1415993 | 12/1975 | United Kingdom . | |
| 1447826 | 9/1976 | United Kingdom . | |
| 1459114 | 12/1976 | United Kingdom . | |

*Primary Examiner*—John M. Jillions

*Attorney, Agent, or Firm*—Jones, Tullar & Cooper

[57] ABSTRACT

A reel assembly for winding and unwinding filamentary strand or wire-like material such as electric fencing wire is disclosed. The reel includes a cylindrical core with larger-diameter side plates removably attached thereto. The assembly may include a frame with a cantilevered shaft on which the reel is journaled for rotation. The frame also may include an arm directed radially from one end of the shaft, to which arm is connected a handle which the user can hold to support the assembly. A spring-loaded control pin extends through the arm and has a bevelled end for ratchet-like engagement with appropriately shaped recesses in the adjacent side plate. Adjacent the other side plate is an eccentrically mounted crank extending from the shaft which the user can manipulate to rotate the reel on the shaft. The reel assembly is simple to manufacture and use and is sufficiently inexpensive to be disposable after use.

7 Claims, 4 Drawing Sheets

REEL ASSEMBLY

The present invention relates to a spool or reel assembly used for winding and unwinding filamentary strand-like or wire-like material. In particular the invention relates to a portable, preferably disposable, reel assembly that might be used to hold, and unwind therefrom, wire used in electric fences.

BACKGROUND OF THE INVENTION

Electric fences, used to keep animals such as cattle or sheep in a specific area, may be either permanent or temporary. A permanent electric fence will include a standard fence secured to fence posts and a electrified wire portion also secured to the fence posts. Such a fence might, for example, define the perimeter of a farm to keep the animals within that perimeter. A temporary electric fence might be used, for example, to keep animals within a specific meadow so as to prevent them from feeding elsewhere or it might be used to exclude animals from a specific area. Once it has been decided to alter the feeding program for the animals, for example, the temporary fence would be taken down and reassembled at another location.

When putting up or taking down a temporary electric fence it is of course necessary to deal with the wire which will be electrified as part of the fence. In the past the wire has been supplied on spools which are awkward to handle, especially when using a vehicle such as a pickup truck, which truck would traverse the fence line as the wire is unwound therefrom. Rewinding of the wire onto the spool after the temporary fence had served its purpose was both unwieldy and time consuming.

SUMMARY OF THE INVENTION

There is a need for a lightweight, portable, inexpensive reel or spool onto which or from which electric fence wire can be wound or unwound respectively. The present invention meets that need by providing a reel assembly that is simple and inexpensive to manufacture from cheap plastics material. The component parts of the reel assembly can be easily connected together or taken apart, permitting several size alternatives from different combinations of the components. The knock-down or kit nature of the invention simplified shipping and improves the storage and inventory situation for the wire supplier as he does not have to store large, space-taking, integrally formed reels or spools. He can store the various components and assemble only the reels that he needs.

The reel assembly of the invention includes a reel made up of a core member on which the material is wound and a pair of separate side plates easily removably connectable to the core member. One of the side plates has an eccentrically positioned crank projecting therefrom and the other side plate has a plurality of circumferentially spaced recessed in the outer surface thereof. A separate frame has a shaft on which the reel is journaled to rotate and also includes an arm which extends radially away from the shaft at one end thereof. A handle is connected to the arm and overlies the core at about the mid-point thereof. A user can grasp the handle to support the reel assembly and turn the reel by the crank to wind or unwind material to or from the reel.

A control is provided on the frame arm and is movable between two positions for engagement with the recesses in the other side plate to provide a ratcheting or braking action on the reel during winding or unwinding. The control can be moved to a third position to permit free-wheeling of the reel during winding or unwinding.

In summary of the above the present invention can be broadly considered as providing a reel assembly for selectively winding or unwinding flexible wire-like material thereon or therefrom comprising: (a) a reel member having a core member and larger-diameter side plates; (b) frame means including a cantilevered shaft on which the reel member is journaled for rotation; (c) means for imparting rotational movement to the reel member; (d) handle means connected to the frame means for supporting the reel member during winding or unwinding; and (e) control means on the frame means, engageable with the reel member to selectively (i) permit free-wheeling rotational movement of the reel member relative to the frame means in either a winding direction or an unwinding direction; or (ii) permit ratcheting movement of the reel member in one of the directions with consequent braking action on the reel member in the other of the directions.

The present invention may be looked at in a broader sense as well since there is a need for spools or reels which are assembled at the end-user's facility rather than at the spool manufacturer's factory. Shipping costs could be reduced in view of the reduced volume being shipped and inventory control would be enhanced by the end-user. Different capacities of reels could be assembled using different core lengths and side plates of a uniform diameter or by using cores of a uniform length and side plates of different diameters. The end-user could have an inventory of appropriately sized side plates and cores and could "mix and match" the cores and side plates to achieve the desired spool capacities.

Thus the invention may also be considered as providing a reel assembly for selectively winding or unwinding flexible filamentary material thereon or therefrom comprising a cylindrical core member and pair a of side plates, each side plate having means on an inner surface thereof for supporting one end of the core member thereon, the supporting means each including means matable with the core member to removably secure the core member to the adjacent side plate.

DESCRIPTION OF THE PREFERRED EMBODIMENT

Figure 1:
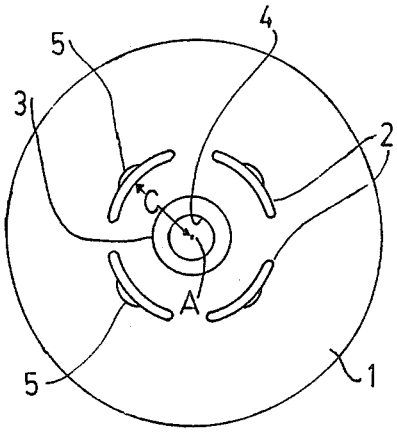
FIG. 1 shows an end view of a side plate used in the basic invention.
Figure 2:
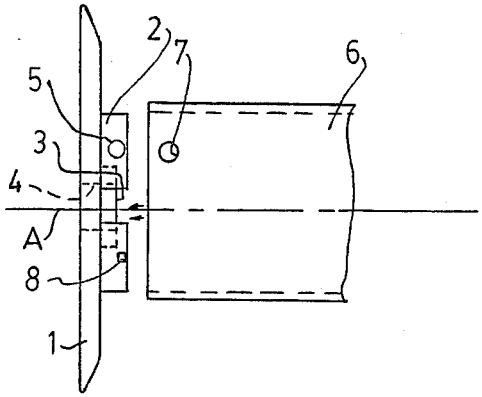
FIG. 2 shows an edge view of the side plate of FIG. 1 along with a core used therewith.

FIGS. 1 and 2 show an end view of a typical side plate embodying features which make the basic invention, as well as the electric fence wire carrying version thereof, so effective. The side plate 1 is shown to be generally cylindrical in nature and to have a plurality of arcuate support legs 2 upstanding from the inner surface thereof, the legs being on a common circumference C spaced outwardly from the rotational axis A. Each leg has a slight degree of flexibility associated therewith for purposes to be described hereinafter. If desired the side plate can have a cylindrical hub 3 moulded thereon, the hub having a through bore 4 to receive a shaft on which the resulting reel assembly is to be mounted.

The side plate 1 is preferably moulded from a high strength, inexpensive plastics material such as polypropylene. Such a material is not conveniently bondable to other materials, plastics or otherwise, and accordingly the present invention provides a unique mechanism for mounting a core to the side plate 1. In the embodiment as illustrated the legs 2 each have a raised dome 5 moulded thereon, the dome being closer to the outer edge than to the end plate itself. The core 6 may then be provided with circular holes 7 appropriately positioned to receive and mate with the domes 5 when the core is pushed over the support legs 2. The legs 2 center and support the core on the side plate 1 while the domes cooperate with the holes 7 to secure the core to the side plate. The fit between the core and the support leg and between the domes and the holes is tight for a secure assembly but is not so tight to preclude disassembly of the core and side plate if desired.

The core 6 may be extruded from a plastics material such as polypropylene or, even more advantageously, it may be formed from a cellulosic material such as cardboard. The manufacture of cardboard cylinders having high strength is well known, examples of such products being cores for paper towelling and toilet tissue, mailing tubes for posters and blueprints, and forms for concrete posts. The last-mentioned products, such as those sold under the trade mark SONOTUBE, are well-suited to the present invention as they have a high strength-to-weight ratio, come in many different diameters, can be precisely cut to length from a longer piece, can be easily punched for the holes 7, can be supplied in a waxed or unwaxed condition, and will be biodegradable after having been discarded.

If a cardboard core is used then it would be possible, in the alternative, to replace the domes 5 with a saw-tooth like projection 8, as shown on one leg 2, which would bit into the inner surface of the core when it is assembled to the end plate 1. In this instance it would be somewhat more difficult to take the assembly apart and it is likely that the core would not be reusable thereafter.

By using a reel or spool assembly such as described herein the end-user does not have to purchase assembled reels from a reel manufacturer, as he merely buys supplies to side plates and cores, assembling the desired reels as they are needed. He can "mix and match" side plate and cores to produce reels of the desired carrying capacity. His storage area is better utilized and likely his inventory can be reduced.

The reel manufacturer also benefits as he does not have to perform a costly and inefficient assembly operation by which he would have bonded cores to side plates and his shipping costs would be reduced as he can ship plates and cores separately, shipping more product per unit volume. The reel manufacturer could even stop making cores if he desired, concentrating only on moulding end plates, as he could readily purchase cores from a cardboard tube manufacturer, already cut to size.

Reel assemblies in accordance with this invention could be used in any application calling for a reel or spool on which a filamentary material is to be wound. In particular they would be beneficial to those using electrical wire, such as electricians and suppliers thereof. Another area in which the present invention would be useful is in the electric fence wire field and a particular embodiment of the invention for such use is described hereinafter in relation to FIGS. 3 to 6.

Figure 3:
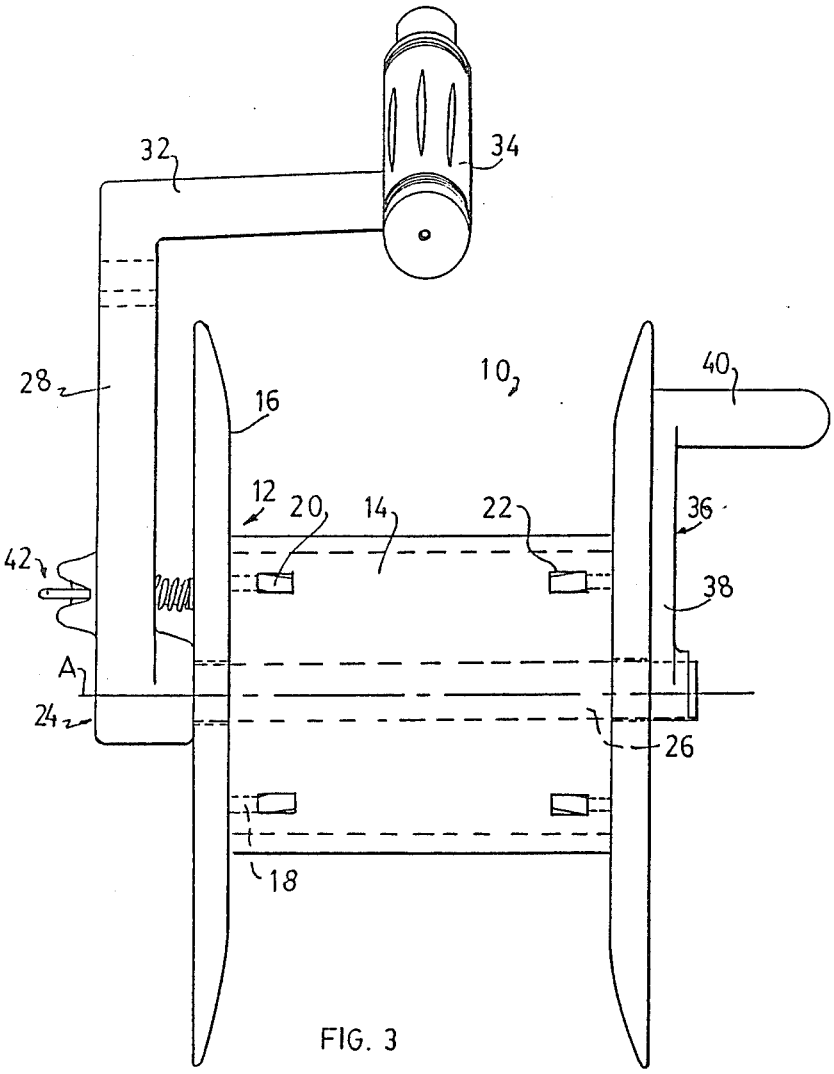
FIG. 3 shows an electric fence wire reel assembly of the present invention in a front elevation thereof.

FIG. 3 shows an elevational view of a reel assembly 10 from which it is seen that the reel or spool 12 thereof includes a central cylindrical core member 14 and a pair of circular side plate or flanges 16 of a diameter greater than that of the core member. In this case side plates 16 are removably attached to the core member 14 by way of resilient, inwardly directed fingers 18 which have a bevelled tooth 20 at the free end thereof for reception in the rectangular apertures 22 found in the body of the core member 14. To assemble the side plates 16 to the core member 14 the two elements are brought together so that the fingers 18 project into the hollow core member until the teeth 20 snap into the respective apertures 22. To disassemble the side plates from the core member, if desired, one pushes the teeth 20 radially inwardly to disengage them from the apertures 22, after which each side plate can be withdrawn axially from the core member.

A frame member 24 is used for holding the reel assembly during use thereof. The frame 24 includes a central shaft 26 which extends through the core member 14 and hubs on the side plates, and on which the reel 12 is free to rotate. An arm 28 extends radially from one end of the shaft 26 and at its free end the arm is provided with a downwardly and forwardly opening hook 30 which permits the entire reel assembly 10 to be hooked onto a wire of an existing fence or any other appropriate support.

Transverse member 32 extends axially across one of the side plates 16 and terminates intermediate the side plates in an insulated handle member 34 which can be used to hold the reel assembly during usage thereof. The handle 34 is located generally at the mid-point of the reel 12 so as to be vertically aligned with the center of gravity of the assembly 10, thereby ensuring that the assembly can be comfortably held during use.

As shown in FIG. 3, one of the side plates 16 has a crank arm 36 positioned adjacent thereto, the crank arm 36 including a radially extending arm portion 38 and an eccentric, axially extending crank portion 40. Adjacent the end of the shaft the crank fits over and is locked to an outwardly extending portion of the side plate 16. With the handle 34 being held by one hand the user can rotate the reel 12 on the shaft 26 by appropriate movement of the crank 40 about the shaft axis A.

A control means 42 is provided at the other end of the reel assembly and is seen in FIGS. 3 to 6. The control means 42 includes a bore 44 which extends through frame arm 28 parallel to axis A at a radial distance R therefrom. A pin 46 passes through the bore 44 and has a bevelled end 48 adjacent the outer surface of side plate 16. A washer or other retainer 50 is fixed to the pin adjacent end 48 and a compression spring 52 is located on the pin 46 between the washer 50 and the adjacent surface of the arm 28. On the other side of the arm 28 the pin is provided with a pull ring 54, the plane of which is perpendicular to the plane containing the face of the bevelled end 48.

Figure 5:
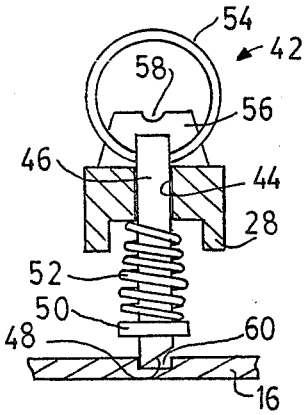
FIG. 5 shows a partial cross-section of the control means in a ratcheting position, the section taken on the line 5—5 of FIG. 4.
Figure 6:
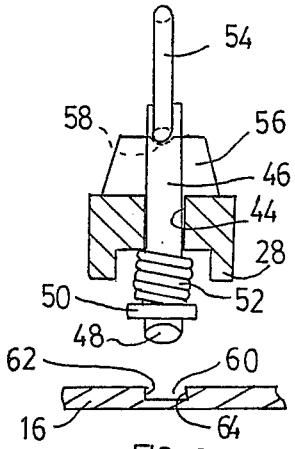
FIG. 6 shows a view similar to FIG. 5 with the control means in a free-wheeling position.

As best seen in FIGS. 5 and 6 a pair of parallel lugs 56 is positioned on the arm 28 so as to project outwardly thereof, one lug being above the pin and the other being below. Each lug has a recess 58 in the outer edge thereof, adapted to receive the pull ring 54.

Figure 4:
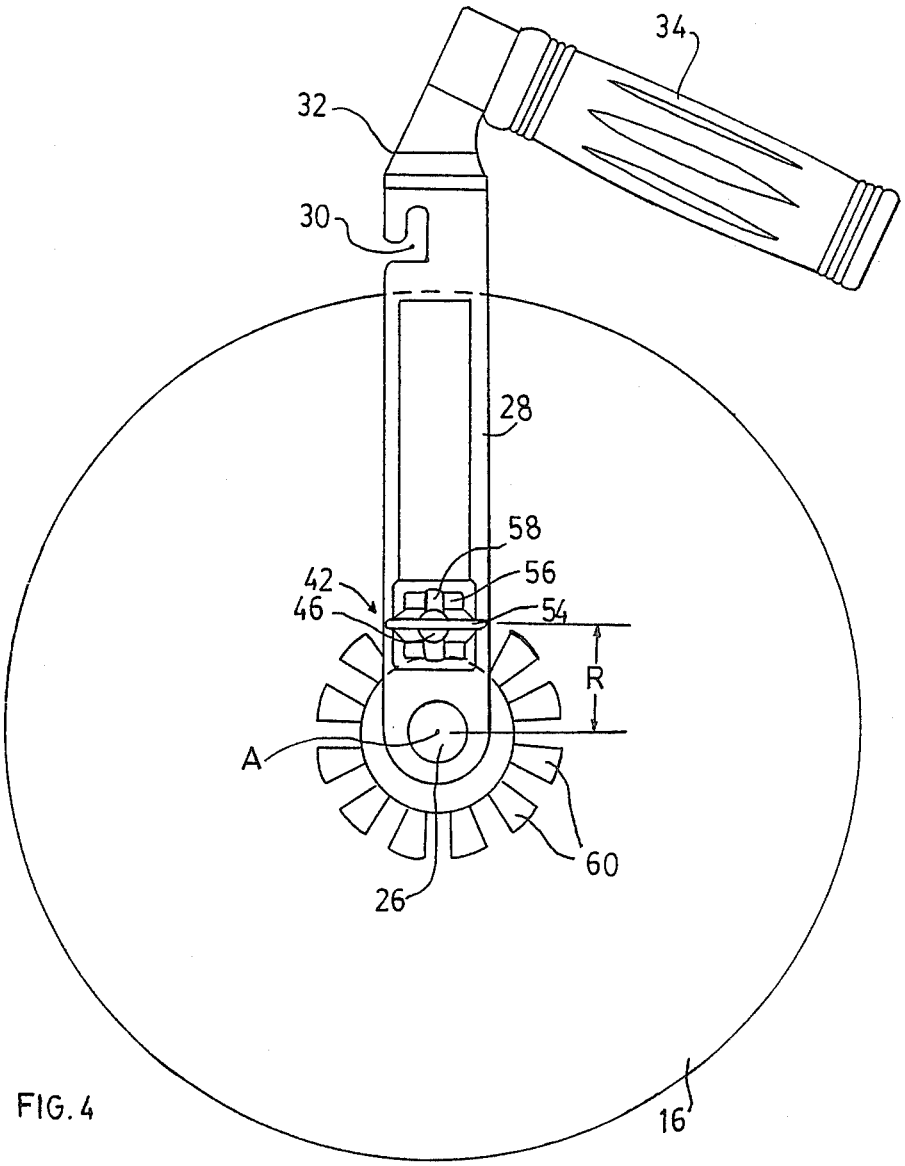
FIG. 4 shows a left end view of the reel assembly of the present invention.
Figure 10:
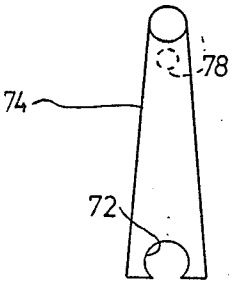
FIG. 10 shows an end view of the crank handle of the second embodiment.
Figure 8:
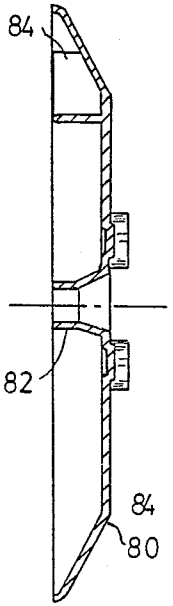
FIG. 8 shows a cross section of the side plate of the second embodiment, taken on the line 8—8 of FIG. 7.

As seen in FIG. 4 the outer face of the side plate 16 adjacent arm 28 has a plurality of circumferentially spaced recesses 60 at essentially the same radial distance R as the bore 44. The recesses 60 are each adapted to receive the bevelled end 48 of the pin 46 as shown in FIG. 5. The actual shape of the recesses 60 is not important with the exception that the radial edges 62,64 thereof should be straight for proper engagement by the adjacent end of the pin 46 as will be described hereinbelow.

The reel assembly of this embodiment is also designed so that it has specific advantages at each stage of its life. By being moulded from a suitable plastics material, such a polypropylene, it is inexpensive to produce and it can be manufactured as a set of discrete components which can be shipped in groups of core members, side plates, frames and control means to the next stage in the chain. The person, or company, that will be winding wire on the reel assembly for subsequent sale thereof can easily and quickly assemble the necessary reels from his supply of components as required and is not faced with a large space-occupying inventory of assembled reels. The kit nature of the present invention also allows the assembly of different reel assemblies using common components. For example reel assemblies having different capacities could be assembled from common side plates and core members of different lengths or from common core members and side plates of different diameters.

After assembly of the reels as previously described the wire or other filamentary or stranded material is wound on a reel and the wound reel is sent off for sale as a package including a frame and a control means. The end-user purchases the package for his own purposes which, most likely, will involve the stringing of electric fence wire around a field to establish a permanent or temporary pasture. While the above-mentioned use is the one for which the present invention was designed it is clear that it is not restricted to that use and that it could be used for winding and unwinding any kind of string or wire-like material.

There are two possible ways of unwinding material from the reel 12. One can attach the free end of the material to a fixed point such as a fence post and then carry the reel assembly 10 along the desired path, allowing the material to pay out from the reel as the reel 12 rotates. The alternative is to leave the reel assembly 10 at a specific location, as for example supported by hook 30 on an existing fence wire, and to grip the material at its free end, unwinding the material from the reel 12 as the desired path is followed. With either alternative it would probably be desirable to permit the reel 12 to "free-wheel" on the shaft 26 and this is possible by pulling the pin 46 axially outwardly via pull ring 54 against the force of spring 52, rotating the pin through 90° and letting the ring 54 rest in the recesses 58 of the lugs 56 as shown in FIG. 6. In this position the bevelled end 48 of the pin 46 will have not contact with the recesses 60 in the adjacent side plate 16.

If one is winding the material back onto the reel 12 one would not want the reel to rotate in the opposite direction if the winding movement is stopped for any reason. Winding is accomplished by moving the crank 40 in a circular arc about axis A and during winding the pin 46 is positioned as shown in FIG. 5 with the pull ring released from the recesses 58 and the spring 52 biasing the bevelled end 48 towards to end plate 16. During winding the face of the bevelled end 48 is positioned so as to face in the direction opposite to the winding direction so that it can ride up over the faces 64 of the recesses 60 in the manner of a ratchet and so that the back portion of the pin can abut a face 62 to prevent inadvertent unwinding of the reel if the winding motion is stopped.

It should be pointed out that the ratcheting capability of the pin 46 could be utilized during an unwinding operation merely by pulling the pin axially away from the side plate 16, rotating it through 180° so that the face of the bevelled end 48 faces in the direction opposite to that for the winding operation, and releasing the pin so that it can assume its ratcheting position with the bevelled end 48 entering and leaving the recesses 60 as the reel rotates. In this position the pin 46 acts as a brake on the reel 12.

Figure 9:
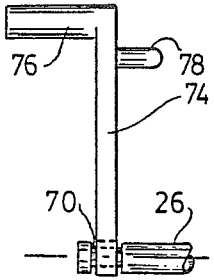
FIG. 9 shows a side view of the crank handle arrangement of the second embodiment.
Figure 7:
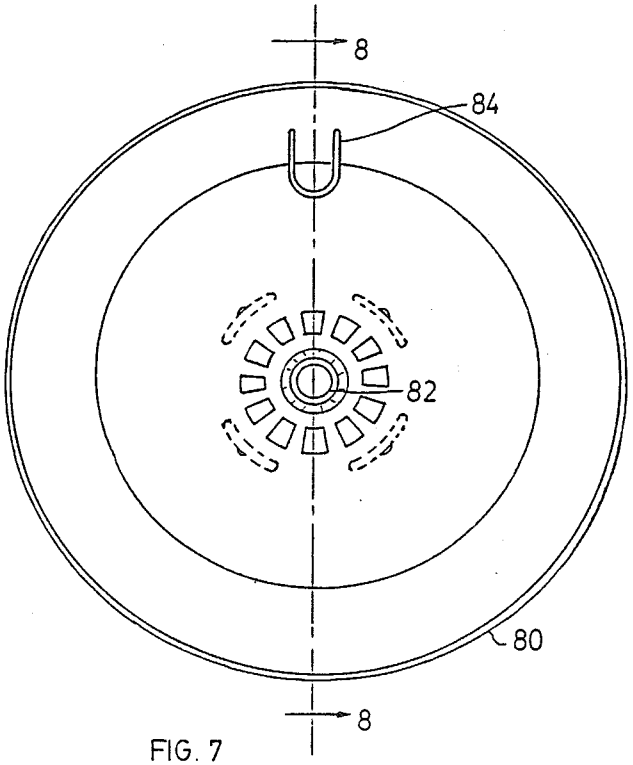
FIG. 7 shows an end view of a side plate as used in a second embodiment of this invention.

FIGS. 7 to 10 illustrate a second embodiment of this invention which utilizes a somewhat different arrangement for attaching the crank handle to the reel assembly. In this embodiment the shaft 26 is connected to the frame member 24 at one end, as in the embodiment of FIGS. 3–6. At the other end, however, the shaft 26 has a groove 70 cut therein, which groove is adapted to receive an arcuate cut-out portion 72 of the crank handle 74. The handle 74 has a cylindrical grip 76 extending outwardly therefrom, similar to crank portion 40, and it also has a pin 78 projecting inwardly thereof, as best seen in FIG. 9.

When the reel assembly is assembled together on the shaft 26, with two side plates 80 engaging the core member 14, the grooved end of shaft 26 will project outward beyond the hub 82 of one plate 84. The crank handle 74 can then be assembled to the shaft, by snapping the cut-out portion 72 of the crank handle over the reduced-diameter shaft portion at the groove 70, while simultaneously guiding the pin 78 into a U-shaped slot 84 which is integrally moulded on the side plate 80. Rotating movement applied to the crank handle 74 through the grip 76 will cause the reel assembly to rotate in the desired direction due to driving interengagement between the pin 78 and the slot 84.

The other components of the reel assembly of this embodiment are as previously described, although the pin 46 could have its end 48 cut straight across, rather than bevelled as in FIGS. 5 and 6. In this case the pin would engage a recess 60 to prevent rotation of the reel assembly in either direction. When the pin 46 is disengaged from a recess 60 rotation can take place in either direction.

The present invention is simple, inexpensive to manufacture, assemble and use and represents an advance in the art of reeling filamentary material. In fact the reel assembly of this invention is so inexpensive that is could be considered as being disposable after a single use.

The foregoing has described the invention as contemplated but it is clear that persons skilled in the art could undoubtedly effect changes thereto without departing from the spirit of the invention. Thus, the protection to be afforded the present invention should be determined from the claims appended hereto.

The embodiments of the invention in which an exclusive property or privilege is claimed are defined as follows:

1. A reel assembly for selectively winding or unwinding flexible electrically conductive material thereon or therefrom comprising:

(a) a non-conductive reel member having a cylindrical core member and larger-diameter side plates removably attached to said core member;

(b) frame means including a cantilevered shaft on which said member is journaled for rotation, one arm extending radially from one end of said shaft to beyond the outer rim of an adjacent side plate, and a transverse member extending from the free end of said arm parallel to said shaft, terminating adjacent the mid-point of said core member;

(c) crank means for imparting rotational movement to said reel member on said shaft, said crank means including an arm member removably engageable with the other end of the shaft adjacent the other sideplate, said arm member including inwardly directed projection means removably engageable with mating U-shaped slot means on said other side plate and an outwardly projecting crank handle at the free end thereof;

(d) insulated handle means connected to the free end of said transverse member at an acute angle with respect thereto for supporting said reel member during winding or unwinding; and (e) control means on said frame mean engageable with said reel member to selectively (i) permit free-wheeling rotational movement of said reel member relative to said frame means in either a winding direction or an unwinding direction; or (ii) permit ratcheting movement of said reel member in one of said directions with consequent braking action on said reel member in the other of said directions.

2. The reel assembly of claim 1 wherein said core member of said reel member is a hollow cylinder and each of said side plates includes finger means releasably lockable with said cylinder to form said reel member.

3. The reel assembly of claim 1 wherein said core member is a hollow cylinder and each of said side plates includes a plurality of arcuate leg members extending from an inner surface thereof on a common circular line for a tight fit with an inner surface of said core member.

4. The reel assembly of claim 3 wherein each of said leg members includes a raised dome thereon for mating with a corresponding hole extending radially through said core member.

5. The spool assembly of claim 1 wherein said control means includes a bore extending through said frame arm parallel to said axis; a pin extending through said bore and having a bevelled end adjacent said other side plate, a radially-outwardly extending retainer adjacent said bevelled end, a compression spring between said retainer and said arm and a pull ring at the other end; lug means on said arm adjacent said ring; and a plurality of circumferentially spaced recesses in said other side plate at the same radial distance from said axis as said pin for selective engagement by said bevelled end of said pin.

6. The spool assembly of claim 1 wherein said control means includes a bore extending through said bore having a straight end adjacent said other side plate, a radially-outwardly extending retainer adjacent said bevelled end, a compression spring between said retainer and said arm and a pull ring at the other end; lug means on said arm adjacent said ring for selective engagement by said ring to provide said free wheeling rotational movement and said racheting movement of said reel member; and a plurality of circumferentially spaced recesses in said other side plate at the same radial distance from said axis as said pin for selective engagement by said straight end of said pin.

7. The spool assembly of claim 1 wherein all components of said assembly are molded from a plastics material.

* * * * *

UNITED STATES PATENT AND TRADEMARK OFFICE

CERTIFICATE OF CORRECTION

PATENT NO. : 4,747,561

DATED : May 31, 1988

INVENTOR(S) : Sweeny et al

It is certified that error appears in the above-identified patent and that said Letters Patent is hereby corrected as shown below:

In Claim 6, line 28 (column 8), between "said" and "bore" insert the following:

--frame arm parallel to said axis; a pin extending through said--

Signed and Sealed this

Eleventh Day of October, 1988

*Attest:*

*Attesting Officer*

DONALD J. QUIGG

*Commissioner of Patents and Trademarks*